US005944570A

United States Patent [19]

Appleby

[11] Patent Number: 5,944,570

[45] Date of Patent: Aug. 31, 1999

[54] SURF RIDING CRAFT

[76] Inventor: J. Randolph Appleby, 313 17th St., Huntington Beach, Calif. 92648

[21] Appl. No.: 09/085,597

[22] Filed: May 28, 1998

[51] Int. Cl.[6] ..... B63B 1/00

[52] U.S. Cl. ..... 441/65; 441/74

[58] Field of Search ..... 114/39.2, 357; 441/65, 74, 79

[56] References Cited

U.S. PATENT DOCUMENTS

| | | | |
|---|---|---|---|
| 2,355,302 | 8/1944 | Kirchner | 9/11 |
| 3,111,695 | 11/1963 | Kelly, Jr. | 9/310 |
| 3,414,919 | 12/1968 | Gust | 9/310 |
| 4,798,549 | 1/1989 | Hirsch | 441/74 |
| 4,887,986 | 12/1989 | Langenbach et al. | 441/74 |
| 4,964,825 | 10/1990 | Paccoret et al. | 441/74 |
| 5,114,370 | 5/1992 | Moran | 441/65 |
| 5,145,430 | 9/1992 | Keys et al. | 441/74 |
| 5,275,860 | 1/1994 | D'Luzansky et al. | 428/71 |

FOREIGN PATENT DOCUMENTS

| | | | |
|---|---|---|---|
| 3124768 | 8/1983 | Germany | 441/74 |

*Primary Examiner*—Ed Swinehart
*Attorney, Agent, or Firm*—Dennis W. Beech

[57] ABSTRACT

The surf riding craft is a shaped water surfboard which has a prestressed center stringer with a foam core element located on each side of the stringer to form a center core element. The bending of the stringer at the tail end in manufacture creates a spring condition tending to force the surfboard back to the original straight position. There is a patch layer bonded to the top and bottom of the center core element for added strength yet relatively more flexibility of the midsection element section compared to the nose and tail sections of the craft. The craft is then covered by the bonding of a top skin and a bottom skin. Three fins are mounted near the tail of the craft. This construction provides for bending and torsional motion about the midsection element of the craft to provide better performance in surfing waves.

4 Claims, 2 Drawing Sheets

SURF RIDING CRAFT

BACKGROUND OF THE INVENTION

1. Field of the Invention

This invention relates to surf boards and other surf riding craft such as body boards and the like. The present invention improves the performance in riding waves by bending and torsional motion of nose and tail segments of the craft relative to the midsection.

2. Description of Related Art

There are currently in use many designs of surf boards, body boards and the like for riding on waves in water. Various designs incorporate stiffening elements in the water craft as well as providing for segmented elements of flexure in such devices.

Currently known designs include the well known body board which most often provides a fairly rigid tail or back one half to two thirds of the board with a flexible nose section. This allows the user to bend the nose for turning the body board.

Other examples of known variable flexure designs include those disclosed in U.S. Pat. Nos. 5,145,430 and 4,887,986. In the first instance a surf riding board has a relatively stiff bottom element with a stiffening spline attached to the top surface. This forms the structural elements of the design. To this are added relatively soft filler pads on each side of the stiffening spline, a top surface for the user to stand on, and rails or edges on the sides. This design provides a relatively uniform structure along the longitudinal dimension of the board.

The second patent disclosure provides for two flexible side portions in the tail section of the surf riding board on each side of a narrow bridge. The two flexible side portions are created primarily in the bottom portion of the board and are designed for stability in difficult water conditions and during maneuvering.

The present invention uses a center stringer with foam core elements located on each side. The center stringer is gently curved upward from center to ends in manufacture to create a spring effect to resist upward bending and to create a tendency to return to the original straight position. A midsection element is bonded to the top and bottom of the center core element to create a flexible strong bond midsection to provide for flexure and torsional motion. When the craft is enclosed with a top skin and bottom skin, the board is structured for torsional motion about the stringer for the nose and tail sections with the relatively flexible midsection and relatively more bending ability in the tail as the stringer is prestressed in this area. This provides for better performance as the twisting and bending in the tail under pressure provides a spring action on release and for maneuvering for turning due to the torsional bending motion.

SUMMARY OF THE INVENTION

One object of the present invention is to allow upward bending of the tail section of the device. Another object is to cause a stressed spring effect in the tail of the device. A further object is to allow torsional motion about the stringer in the midsection and tail section of the device.

In accordance with the description presented herein, other objectives of this invention will become apparent when the description and drawings are reviewed.

DESCRIPTION OF THE PREFERRED EMBODIMENT

Figure 1:
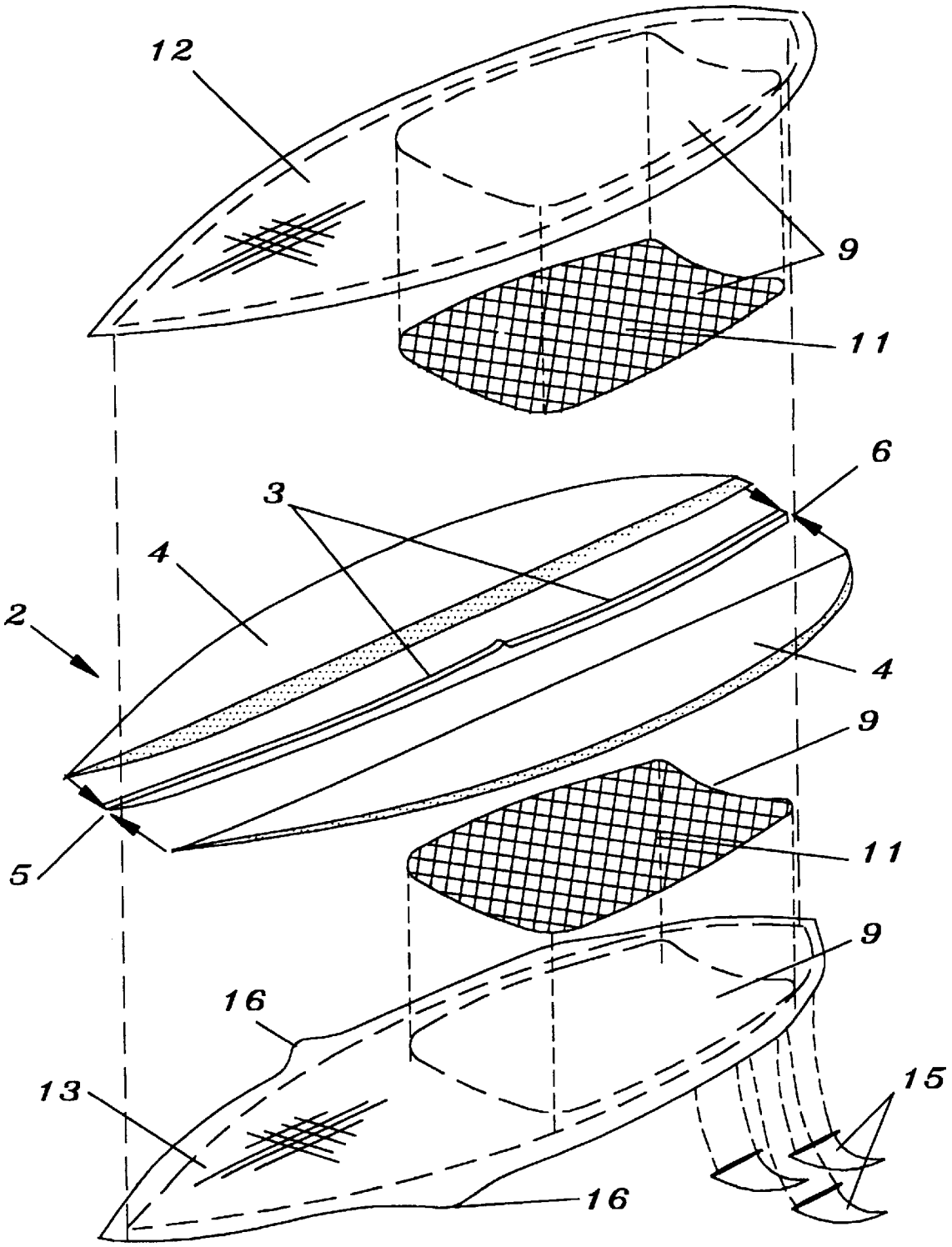
FIG. 1 illustrates a perspective exploded view of the elements of the surf riding craft.
Figure 2:
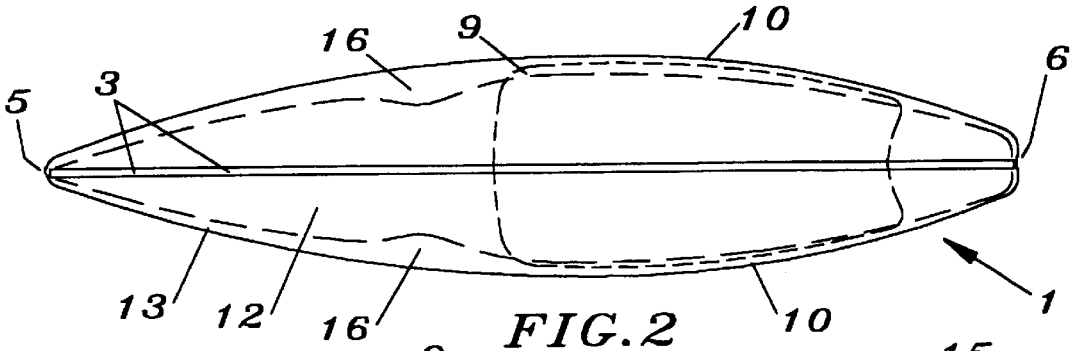
FIG. 2 illustrates a top plan view of the device.

The surf riding craft has a prestressed bridge or stringer with molded and shaped foam core elements located on each side to form the core center element. A midsection woven reinforced fabric with a 45 degree angled material patch layer is attached to the top and bottom of the core center element and a top and bottom skin or cloth of two component epoxy resin with added fillers is used to form the outer layer and surface of the craft. The stringer is bowed during manufacture in a gentle curve downward for about one half of its length from the tail to create the rocker shape and a stress condition to return to the original straight shape.

Referring to FIGS. 1, 4, 6 and 7 the surf rider craft (1) has a center core element (2) which is formed with a stringer (3) and a shaped foam core element (4) located on each side thereof. The stringer (3) may be a wood or carbon/graphite reinforced material. The two foam core elements (4) are formed of a flexible semi-rigid two component polyurethane foam with low density, approximately 1.5–2.0 pounds per cubic foot, or extruded polystyrene foam, of which a typical material is that available under trademark ARCEL, or other like material.

Figure 4:
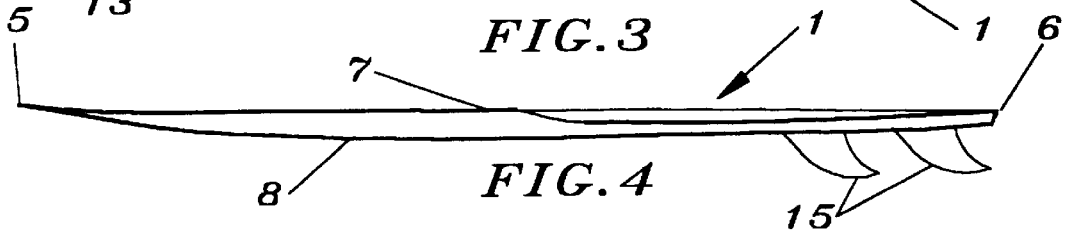
FIG. 4 illustrates a side elevation view of the device.
Figure 5:
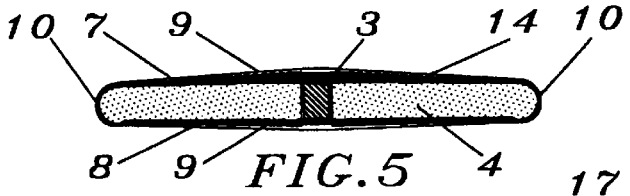
FIG. 5 illustrates a cross sectional view of the device with various layers of elements.
Figure 6:
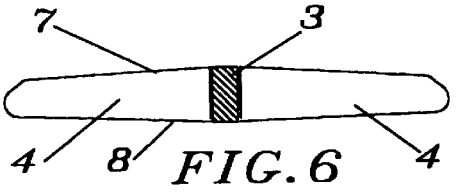
FIG. 6 illustrates a cross sectional view of the center core element.
Figure 7:
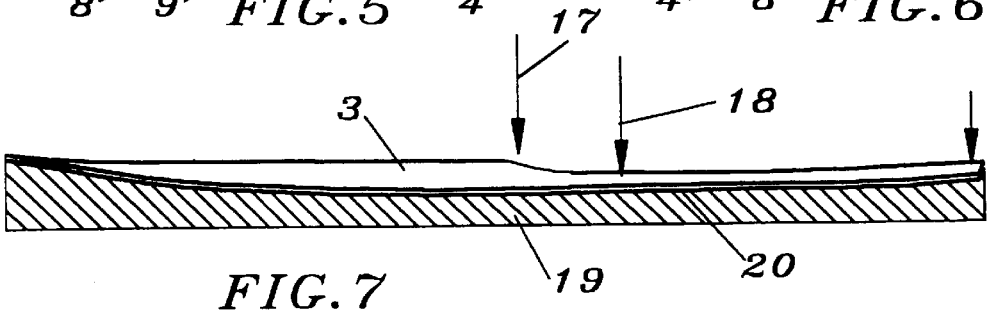
FIG. 7 illustrates a side elevation view of the stringer positioned on a stringer bending form.

During manufacture the stringer (3) is bowed in a gentle curve downward for its entire length to form the rocker shape from nose (5) to tail (6) as illustrated in FIG. 4. The stringer (3) is first formed with an upward curve from the approximate center to ends and relatively thicker structure in the nose (5) half of the stringer (3) relative to the tail (6) half as illustrated in FIG. 7. The tail (6) half of the stringer (3) is approximately straight at this step of the manufacture. The stringer (3) is then further bowed downward under pressure (18) in a stringer bending form (19) to produce a gentle curve downward for approximately one half of its length from the tail (6) to complete the overall rocker shape (20) of bending form (19). The tail (6) end being relatively thinner bends in the bending form (19) as compared to the nose (5) end. The stringer (3) may also be fixed at point (17) such that the tail (6) has an initial downward bend from point (17) prior to the transition to an overall upward bend to the tail (6).

This creates a craft tail (6) or rear with a top (7) concave and bottom (8) convex curved shape longitudinally. In addition the stringer (3) is thereby in a stress or spring condition with energy to tend to return to the original straight shape. Therefore, any force tending to bend the tail (6) end upward must act against this spring force thus providing a strong resistance to bending in an upward direction and a strong force to return to the original shape.

Referring to FIGS. 1 through 5, a midsection element (9) is attached to the center core element (2) top and bottom beginning approximately ½ the distance from the nose (5) and ending approximately ⅕ the distance from the tail (6). The midsection element (9) generally extends laterally to the sides (10) of the craft (1). The midsection element (9) is preferably formed of a woven reinforced fabric or cloth material patch layer (11) having a 45 degree angled weave relative to the longitudinal dimension of the craft (1). The midsection element (9) patch layer (11) is constructed of an acrylic resin fabric such as polypropylene, fiberglass or like material of which typical materials are those available under trademarks XYNOLE and DYNEL with DYNEL found very suitable in prototypes.

Finally a cloth or a top skin (12) and a bottom skin (13) are bonded to cover the center core element (2) and midsection element (9) to form the outer layer (14) and surface of the craft (1). The outer layer (14) is composed of two component epoxy resin with added fillers. As part of the process of bonding the outer layer (14), wood framed or fiber reinforced epoxy framed fins (15) are attached on the bottom (8) near the tail (6) and blended into the double concave, in the lateral dimension, tail (6) end using the bottom skin (12) material.

The use of the mid section elements (9) provides a flexible reinforced construction relative to the nose (5) and tail (6) in that portion of the craft (1). This in combination with the stringer (3) provides for flexure in the midsection of the craft (1) which is torsional about the stringer (3). Stated differently the more flexible reinforced midsection (9) allows the nose (5) and tail (6) portions to tend to twist about the stringer (3) when under pressure or force of bending when used in surfing in the water while the nose (5) and tail (6) portions will tend to remain rigid. To construct the differences in flexure in the craft (1) the two component epoxy resin used in laminating the patch layers (11) and skins (12, 13) are varied in their stiffness composition. A two component epoxy resin which is relatively rigid is used in the nose (5) and tail (6) sections and a relatively flexible two component epoxy resin is used for the patch layer (11) and midsection element (9) of the skins (12, 13).

This design provides for additional surfing or planning speed due to the spring and torsional action of the tail (6) element action in the water. It provides for stability and ease of turning due to the relative flexibility and shape between the midsection elements (9) and the nose (5) and tail (6) end of the craft (1).

Figure 3:
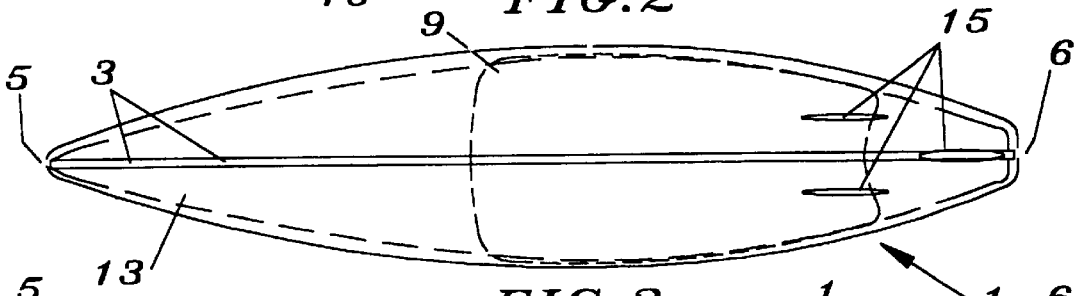
FIG. 3 illustrates a bottom plan view of the device.

Referring to FIGS. 1 and 3, an overlap flap (16) is used in the bottom skin (12) to provide for added strength in the areas of the craft (1) where the user normally grips the surf board. This retards compression of the relatively softer foam core elements (4) in this area which can occur through use.

While the invention has been particularly shown and described with respect to the illustrated and preferred embodiments thereof, it will be understood by those skilled in the art that the foregoing and other changes in form and details may be made therein without departing from the spirit and scope of the invention.

I claim:

1. A surf riding craft comprising:

a center core element with a stringer bowed in a gentle curve downward for approximately one half the stringers length from a tail and having a foam core element located on each side thereof;

a patch layer bonded to the center core element at a top and a bottom to form a midsection element;

a top skin and a bottom skin bonded to and covering the center core element and the two patch layers at the midsection element wherein the midsection element is relatively more flexible than the nose and the tail elements; and a plurality of fins attached on the bottom near a tail end.

2. The surf riding craft as in claim 1 wherein the patch layers are attached approximately ½ the distance of the stringer from the nose and approximately ⅕ the distance of the stringer from the tail; and the patch layers extend laterally to each side of the center core element.

3. The surf riding craft as in claim 1 wherein the patch layers having a cloth weave which is 45 degrees relative to a top skin cloth weave and a bottom skin cloth weave.

4. The surf riding craft as in claim 1 wherein the foam core elements are a predetermined shape and thickness and are a two component polyurethane foam closed cell construction, the patch layers are an acrylic resin fabric, and the bottom skin and the top skin are two component epoxy resin with added fillers.

* * * * *